US010465465B2

(12) United States Patent
Leach et al.

(10) Patent No.: US 10,465,465 B2
(45) Date of Patent: Nov. 5, 2019

(54) SYSTEMS AND METHODS FOR ACTUATING HYDRAULICALLY-ACTUATED DEVICES

(71) Applicant: TRANSOCEAN INNOVATION LABS LTD, George Town (KY)

(72) Inventors: Andrew Leach, Houston, TX (US); Matthew Boike, Magnolia, TX (US)

(73) Assignee: Transocean Innovation Labs Ltd., Grand Cayman (KY)

( * ) Notice: Subject to any disclaimer, the term of this patent is extended or adjusted under 35 U.S.C. 154(b) by 0 days.

(21) Appl. No.: 15/696,863

(22) Filed: Sep. 6, 2017

(65) Prior Publication Data

US 2018/0066493 A1 Mar. 8, 2018

Related U.S. Application Data

(60) Provisional application No. 62/384,070, filed on Sep. 6, 2016.

(51) Int. Cl.

| | |
|---|---|
| ***E21B 21/10*** | (2006.01) |
| ***E21B 34/02*** | (2006.01) |
| ***E21B 33/038*** | (2006.01) |
| ***E21B 33/06*** | (2006.01) |
| ***E21B 33/035*** | (2006.01) |
| ***E21B 34/08*** | (2006.01) |
| ***F15B 1/02*** | (2006.01) |
| ***F15B 1/033*** | (2006.01) |
| ***E21B 34/16*** | (2006.01) |
| ***F15B 19/00*** | (2006.01) |
| *F15B 20/00* | (2006.01) |
| *F15B 13/04* | (2006.01) |

(52) U.S. Cl.

CPC ..... *E21B 33/061* (2013.01); *E21B 33/038* (2013.01); *E21B 33/0355* (2013.01); *E21B 34/02* (2013.01); *E21B 34/085* (2013.01); *E21B 34/16* (2013.01); *F15B 1/022* (2013.01); *F15B 1/033* (2013.01); *F15B 19/005* (2013.01); *F15B 20/00* (2013.01); *F15B 2013/0409* (2013.01); *F15B 2201/411* (2013.01); *F15B 2201/51* (2013.01); *F15B 2211/205* (2013.01); *F15B 2211/212* (2013.01); *F15B 2211/30575* (2013.01); *F15B 2211/327* (2013.01); *F15B 2211/625* (2013.01); *F15B 2211/632* (2013.01); *F15B 2211/6306* (2013.01); *F15B 2211/6309* (2013.01); *F15B 2211/6313* (2013.01); *F15B 2211/6336* (2013.01); *F15B 2211/6343* (2013.01); *F15B 2211/857* (2013.01); *F15B 2211/87* (2013.01)

(58) Field of Classification Search

CPC ..... E21B 21/10; E21B 21/106; E21B 34/02; E21B 33/0355; E21B 33/038

See application file for complete search history.

(56) References Cited

U.S. PATENT DOCUMENTS

2002/0100589 A1 8/2002 Childers et al.
2007/0092358 A1* 4/2007 Innes ..... E21B 7/02 414/22.51

(Continued)

OTHER PUBLICATIONS

International Search Report and Written Opinion in International Application No. PCT/US2017/050227 dated Nov. 16, 2017.

*Primary Examiner* — Cathleen R Hutchins

(57) ABSTRACT

This disclosure includes systems and methods for actuating hydraulically-actuated devices.

17 Claims, 4 Drawing Sheets

(56) References Cited

U.S. PATENT DOCUMENTS

| | | | | |
|---|---|---|---|---|
| 2011/0098946 | A1 | 4/2011 | Curtiss, III | |
| 2011/0267070 | A1* | 11/2011 | Spencer | G01R 31/025 324/509 |
| 2012/0150455 | A1* | 6/2012 | Franklin | G01M 3/2815 702/51 |
| 2015/0096758 | A1 | 4/2015 | Babbitt | |
| 2016/0090810 | A1 | 3/2016 | Holmes et al. | |

* cited by examiner

SYSTEMS AND METHODS FOR ACTUATING HYDRAULICALLY-ACTUATED DEVICES

This application claims priority to U.S. Provisional Application No. 62/384,070, filed on Sep. 6, 2016 and entitled "SYSTEMS AND METHODS FOR ACTUATING HYDRAULICALLY-ACTUATED DEVICES," which is incorporated herein by reference in its entirety.

BACKGROUND

1. Field of Invention

The present invention relates generally to hydraulically-actuated devices, such as blowout preventers, and more specifically, but not by way of limitation, to (e.g., reliability-assessable) systems and methods for actuating such hydraulically-actuated devices.

2. Description of Related Art

A blowout preventer (BOP) is a mechanical device, usually installed redundantly in a stack, used to seal, control, and/or monitor an oil and gas well. A BOP typically includes or is associated with a number of components, such as, for example, rams, annulars, accumulators, test valves, kill and/or choke lines and/or valves, riser connectors, hydraulic connectors, and/or the like, many of which may be hydraulically-actuated.

Due to the magnitude of harm that may result from failure to actuate a BOP, safety or back-up systems are often implemented, such as, for example, deadman and autoshear systems. Such systems should be regularly tested in order to maintain an adequate probability of failure on demand (PFD). PFD, which typically increases over time, is a measure of the probability that a given system will fail when it is desired to function that system.

While testing is an effective way to reduce PFD, testing of existing BOPs and/or safety or back-up systems may be difficult. For example, to traditionally test an existing BOP and/or safety or back-up system, full functioning of the BOP and/or safety or back-up system may be required, in some instances, necessitating time- and cost-intensive measures, such as the removal of any objects, such as drill pipe, disposed within the wellbore, the disconnection of the lower marine riser package, and/or the like.

Furthermore, given the safety-critical nature of such safety or back-up systems, there exists a continued need for safety or back-up systems that have increased fault-tolerance, reliability, and/or the like.

Examples of safety or back-up blowout prevention systems are disclosed in (1) U.S. Pat. No. 8,881,829 and Pub. Nos.: (2) US 2012/0001100, and (3) US 2012/0085543.

SUMMARY

Some embodiments of the present systems are configured to allow for testing of component(s) (e.g., a pressure source, valve(s), and/or the like) associated with actuation of a hydraulically-actuated device without requiring full actuation of the hydraulically-actuated device via, for example, a valve configured to selectively direct fluid from a pressure source to the hydraulically-actuated device or a vent such that, for example, when the valve directs fluid from the pressure source to the vent, other valve(s) upstream of the valve, the pressure source, and/or the like can be tested without fully actuating the hydraulically-actuated device.

Some embodiments of the present systems are configured to have increased fault-tolerance, reliability, and/or the like via, for example: (1) electrically-actuated valve(s) for controlling fluid communication between a pressure source and a hydraulically-actuated device, such as, for example, electrically-actuated mainstage valve(s); and/or (2) (e.g., redundant, scalable, and/or the like) sensor(s) configured to detect at least one of: (i) loss of fluid and/or electrical communication between the blowout preventer stack and an above-sea control station; and (ii) disconnection of the lower marine riser package from the blowout preventer stack.

Some embodiments of the present systems comprise: one or more valve assemblies, each having a conduit defining an inlet configured to be in fluid communication with a pressure source, an outlet configured to be in fluid communication with a respective hydraulically-actuated device, and a vent configured to be in fluid communication with a reservoir and/or a subsea environment and one or more valves in fluid communication with the conduit and including an electrically-actuated first valve that is movable between a first valve first position in which the first valve permits fluid communication from the inlet to the outlet and a first valve second position in which the first valve prevents fluid communication from the inlet to the outlet and a second valve that is movable between a second valve first position in which hydraulic fluid that flows through the second valve from the first valve is directed to the outlet and a second valve second position in which hydraulic fluid that flows through the second valve from the first valve is directed to the vent, and a processor configured to actuate at least one of the valve assembl(ies) between a first state in which the first valve is in the first valve first position and the second valve is in the second valve first position and a second state in which the first valve is in the first valve first position and the second valve is in the second valve second position.

In some systems, for at least one of the valve assembl(ies), the respective hydraulically-actuated device comprises a respective blowout preventer of a blowout preventer stack, the system comprises one or more sensors configured to detect at least one of loss of fluid and/or electrical communication between the blowout preventer stack and an above-sea control station and disconnection of a lower marine riser package from the blowout preventer stack, and the processor is configured to actuate at least one of the valve assembl(ies) to the first state to actuate its respective blowout preventer based, at least in part, on data captured by the sensor(s).

Some embodiments of the present systems for a blowout preventer stack including one or more blowout preventers comprise: one or more valve assemblies, each having a conduit defining an inlet configured to be in fluid communication with a pressure source and an outlet configured to be in fluid communication with a respective blowout preventer of a blowout preventer stack and one or more valves in fluid communication with the conduit and including an electrically-actuated first valve that is movable between a first valve first position in which the first valve permits fluid communication from the inlet to the outlet and a first valve second position in which the first valve prevents fluid communication from the inlet to the outlet, one or more sensors configured to detect at least one of loss of fluid and/or electrical communication between the blowout preventer stack and an above-sea control station and disconnection of a lower marine riser package from the blowout preventer stack, and a processor configured to actuate at least one of the valve assembl(ies) to actuate its respective blowout preventer based, at least in part, on data captured by the sensor(s).

In some systems, for at least one of the valve assembl(ies), the conduit defines a vent configured to be in fluid communication with a reservoir and/or a subsea environment, the one or more valves includes a second valve that is movable between a second valve first position in which hydraulic fluid that flows through the second valve from the first valve is directed to the outlet and a second valve second position in which hydraulic fluid that flows through the second valve from the first valve is directed to the vent, and the processor is configured to actuate at least one of the valve assembl(ies) between a first state in which the first valve is in the first valve first position and the second valve is in the second valve first position and a second state in which the first valve is in the first valve first position and the second valve is in the second valve second position.

In some systems, the sensor(s) comprise a proximity sensor configured to capture data indicative of disconnection of the lower marine riser package from the blowout preventer stack. In some systems, the sensor(s) comprise a pressure sensor configured to capture data indicative of loss of fluid communication between the blowout preventer stack and the above-sea control station. Some systems comprise a relay configured to detect loss of electrical communication between the blowout preventer stack and the above-sea control station. Some systems comprise a voltage sensor configured to capture data indicative of loss of electrical communication between the blowout preventer stack and the above-sea control station. In some systems, at least one of the sensor(s) is configured to capture data indicative of a size of a tubular disposed through the blowout preventer stack. In some systems, at least one of the sensor(s) is configured to capture data indicative of a position of a ram of a blowout preventer relative to a housing of the blowout preventer. In some systems, at least one of the sensor(s) is configured to capture data indicative of at least one of: temperature, pressure, and flow rate of hydraulic fluid within the system.

In some systems, the processor is configured to actuate a first one of the valve assembl(ies) to actuate its respective blowout preventer and, after a predetermined period of time has elapsed since actuating the first one of the valve assembl(ies), actuate a second one of the valve assembl(ies) to actuate its respective blowout preventer. In some systems, the processor is configured to, if data captured by the sensor(s) indicates a fault associated with the respective blowout preventer of a first one of the valve assembl(ies), actuate a second one of the valve assembl(ies) to actuate its respective blowout preventer. In some systems, the processor is configured to actuate at least one of the valve assembl(ies) based, at least in part, on a command received from an above-sea control station.

In some systems, the pressure source comprises at least one selected from the group consisting of: a hydraulic power unit, an accumulator, and a subsea pump. In some systems, the reservoir comprises an accumulator.

In some systems, for at least one of the valve assembl(ies), the second valve comprises an electrically-actuated valve. In some systems, for at least one of the valve assembl(ies), the second valve comprises a three-way valve.

Some systems comprise an atmospheric pressure vessel, where the processor is disposable within the atmospheric pressure vessel. Some systems comprise one or more batteries configured to provide electrical power to the processor and/or at least one of the valve assembl(ies).

Some embodiments of the present methods comprise: actuating a second valve of a valve assembly, the valve assembly including a conduit defining an inlet in fluid communication with a pressure source, an outlet in fluid communication with a blowout preventer, and a vent in fluid communication with a reservoir and/or a subsea environment, where the actuating is performed such that fluid communication through the second valve to the vent is permitted, and actuating an electrically-actuated first valve of the valve assembly such that hydraulic fluid is directed from the inlet, through the first valve, through the second valve, and to the vent. Some methods comprise actuating the second valve such that fluid communication through the second valve to the outlet is permitted and actuating the first valve such that hydraulic fluid is directed from the inlet, through the first valve, through the second valve, and to the vent.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

The phrase "and/or" means and or. To illustrate, A, B, and/or C includes: A alone, B alone, C alone, a combination of A and B, a combination of A and C, a combination of B and C, or a combination of A, B, and C. In other words, "and/or" operates as an inclusive or.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those one or more elements. Likewise, a method that "comprises," "has," or "includes," one or more steps possesses those one or more steps, but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Further, a device or system that is configured in a certain way is configured in at least that way, but it can also be configured in other ways than those specifically described.

Some details associated with the embodiments are described above, and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure.

Rather, the same reference number may be used to indicate a similar feature or a feature with similar functionality, as may non-identical reference numbers.

DETAILED DESCRIPTION

Figure 1:
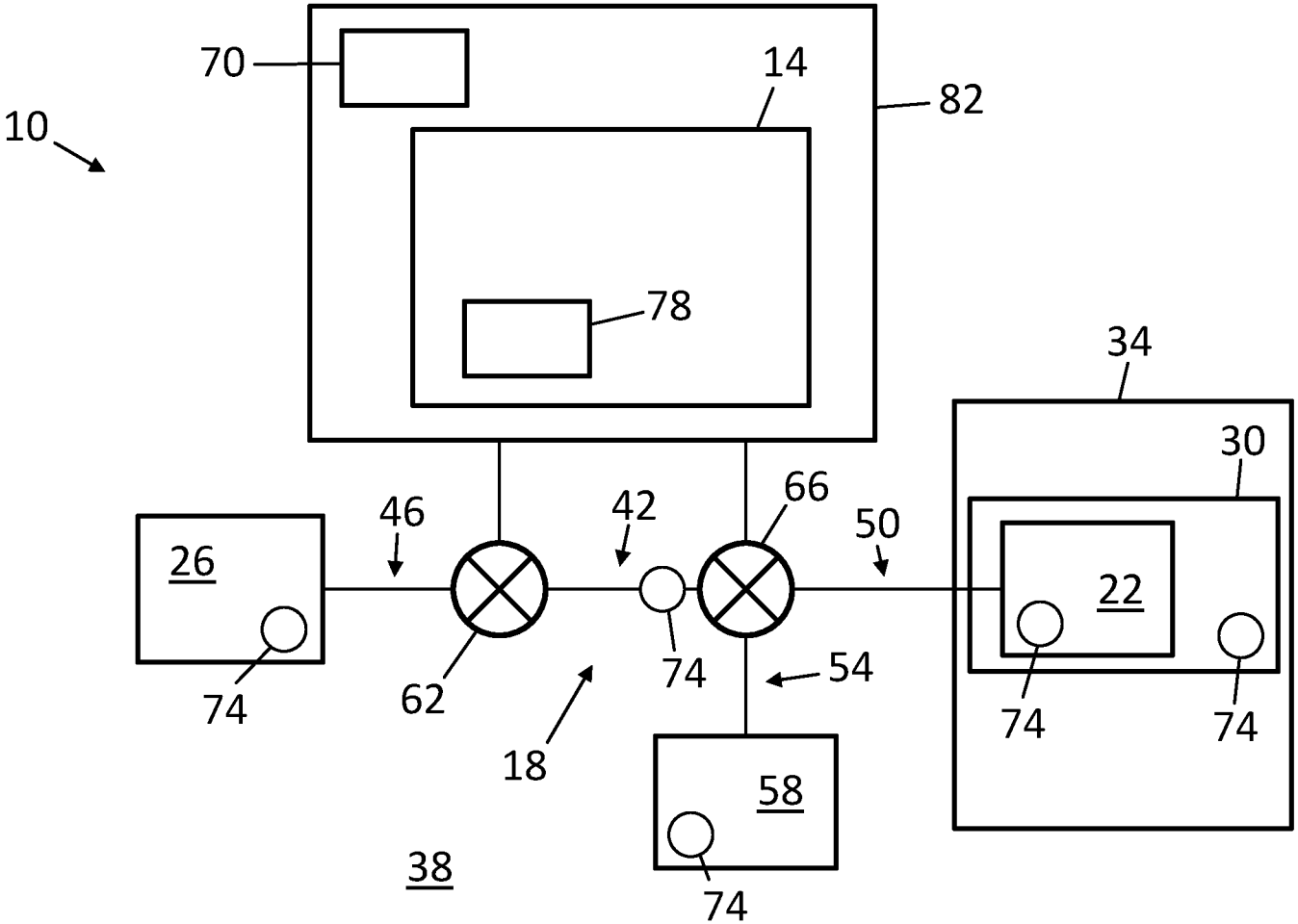
FIG. 1 is a schematic of a first embodiment of the present systems.

Referring now to the drawings, FIG. 1 shows a first embodiment 10 of the present systems. System 10 can include a control unit 14, one or more valve assemblies 18 (e.g., one valve assembly, as shown), a hydraulically-actuated device 22, and a pressure source 26. As will be described in more detail below, system 10 can be configured to actuate hydraulically-actuated device 22, facilitate testing of component(s) (e.g., pressure source 26, valve assembly 18, and/or the like) associated with actuation of the hydraulically-actuated device, and/or the like. Hydraulically-actuated device 22 can be a BOP 30, such as, for example, a ram- or annular-type BOP. BOP 30 can be included in a BOP stack 34. In other embodiments, a hydraulically-actuated device (e.g., 22) can be any suitable device, such as, for example, an accumulator, test valve, failsafe valve, kill and/or choke line and/or valve, riser joint, hydraulic connector, and/or the like.

Pressure source 26 can be configured to provide fluid to hydraulically-actuated device 22 to actuate the hydraulically-actuated device. For example, some hydraulically-actuated devices (e.g., 22) may require fluid at a flow rate of between 3 gallons per minute (gpm) and 130 gpm and a pressure of between 500 pounds per square inch gauge (psig) and 5,000 psig for effective and/or desirable operation, and a pressure source (e.g., 26) configured to actuate such a hydraulically-actuated device can be configured to output fluid at these flow rates and pressures. Pressure source 26 can comprise any suitable pressure source, such as, for example, a pump, accumulator, hydraulic power unit, subsea environment (e.g., 38), and/or the like. By way of example, a pressure source (e.g., 26) can include one or more pumps (e.g., piston, diaphragm, centrifugal, vane, gear, gerotor, screw, and/or the like pump(s)), which may be disposed subsea. Such pump(s) can be driven by electrical motors (e.g., using power supplied by one or more batteries 70, one or more auxiliary lines, and/or the like). The present systems (e.g., 10) can be used with any suitable hydraulic fluid, such as, for example, an oil-based fluid, sea water, desalinated water, treated water, water-glycol, and/or the like.

Valve assembly 18 can include a conduit 42 defining an inlet 46 in fluid communication with pressure source 26 and an outlet 50 in fluid communication with hydraulically-actuated device 22 such that, for example, fluid pressurized by the pressure source can be used to actuate the hydraulically-actuated device via the conduit. Conduit 42 can include a vent 54, which can be in fluid communication with a fluid reservoir 58, such as, for example, an accumulator. In other embodiments, a vent (e.g., 54) can be in fluid communication with a subsea environment (e.g., 38). Conduit 42 can be rigid and/or flexible.

Valve assembly 18 can include one or more valves, such as a first valve 62 and/or a second valve 66, each in fluid communication with conduit 42. First valve 62 can be movable between a first (e.g., open) position, in which the first valve permits fluid communication from inlet 46 to outlet 50, and a second (e.g., closed) position, in which the first valve prevents fluid communication from the inlet to the outlet.

Second valve 66 can be configured to selectively direct fluid flowing within conduit 42 to outlet 50 or vent 54. For example, second valve 66 can be movable between a first (e.g., "outlet") position, in which fluid that flows through the second valve is directed to outlet 50, and a second (e.g., "vent") position, in which fluid that flows through the second valve is directed to vent 54. To illustrate, when second valve 66 is in the first position, the second valve can direct fluid to hydraulically-actuated device 22, to, for example, actuate the hydraulically-actuated device, and, when the second valve is in the second position, the second valve can direct fluid to vent 54, to, for example, facilitate testing of system 10 component(s) without fully actuating the hydraulically-actuated device. In some embodiments, a second valve (e.g., 66) can be movable to a third (e.g., closed) position, in which fluid communication through the second valve is prevented.

Valve(s) 62 and/or 66 can be electrically-actuated; for example, the valve(s) can comprise solenoid valves. An electrically-actuated valve may offer certain advantages over a hydraulically-actuated valve. To illustrate, an electrically-actuated valve may be more reliable (e.g., via not requiring a pilot pressure signal, requiring fewer hydraulic conduits and/or connections to operate, and/or the like), have a quicker response time, be more easily monitored (e.g., via monitoring current, voltage, and/or the like supplied to the valve), and/or the like than a hydraulically-actuated valve. Nevertheless, in some embodiments, valve(s) (e.g., 62 and/or 66) can be hydraulically-actuated. Valve(s) (e.g., 62, 66, and/or the like) of the present valve assemblies (e.g., 18) can comprise any suitable valve, such as, for example, a spool valve, check valve (e.g., ball check valve, swing check valve, and/or the like), ball valve (e.g., full-bore ball valve, reduced-bore ball valve, and/or the like), and/or the like, and can comprise any suitable configuration, such as, for example, two-port two-way (2P2W), 2P3W, 2P4W, 3P4W, and/or the like.

Valve assembly 18 can be actuated between a first (e.g., "actuating") state, in which valve 62 is in the first position and valve 66 is in the first position, and a second (e.g., "testing") state, in which valve 62 is in the first position and valve 66 is in the second position. When valve assembly 18 is in the first state, fluid from pressure source 26 can be directed to hydraulically-actuated device 22 to, for example, actuate the hydraulically-actuated device, and, when the valve assembly is in the second state, fluid from the pressure source can be directed to vent 54 to, for example, facilitate testing of system 10 component(s) without fully actuating the hydraulically-actuated device.

System 10 can include one or more batteries 70 configured to supply power to system component(s), such as pressure source 26, valve assembly 18, control unit 14, and/or the like. One or more batteries 70 can comprise any suitable battery, such as, for example, a lithium-ion battery, nickel-metal hydride battery, nickel-cadmium battery, lead-acid battery, and/or the like. One or more batteries 70 can be rechargeable using, for example, power supplied via one or more auxiliary lines.

System 10 can include one or more sensors 74 configured to capture data indicative of system 10 parameters such as, for example, a pressure, flow rate, temperature, and/or the like of fluid within the system (e.g., within pressure source 26, hydraulically-actuated device 22, fluid reservoir 58, conduit 42, and/or the like), the position of valve(s) (e.g., 62, 66, and/or the like), the dimension(s) (e.g., size, thickness, and/or the like) of an object (e.g., pipe) disposed within BOP 30, a position, velocity, and/or acceleration of a component (e.g., ram) of the BOP, a charge level, discharge rate, and/or the like of a battery 70, a speed of a motor and/or a pump (e.g., of pressure source 26), a torque output by the motor, a voltage and/or current supplied to the motor, and/or the like. Data captured by sensor(s) 74 can be transmitted to processor 78 (described in more detail below), an above-sea control station, and/or the like. Some systems (e.g., 10) can include a memory configured to store at least a portion of data captured by sensor(s) (e.g., 74).

Sensor(s) 74 can comprise any suitable sensor such as, for example, a pressure sensor (e.g., a piezoelectric pressure sensor, strain gauge, and/or the like), flow sensor (e.g., a turbine, ultrasonic, Coriolis, and/or the like flow sensor, a flow sensor configured to determine or approximate a flow rate based, at least in part, on data indicative of pressure, and/or the like), temperature sensor (e.g., a thermocouple, resistance temperature detector, and/or the like), position sensor (e.g., a Hall effect sensor, potentiometer, and/or the like), voltage sensor, current sensor, acoustic sensor (e.g., a piezoelectric acoustic sensor, ultrasonic vibration sensor, microphone, and/or the like), and/or the like.

Figure 2:
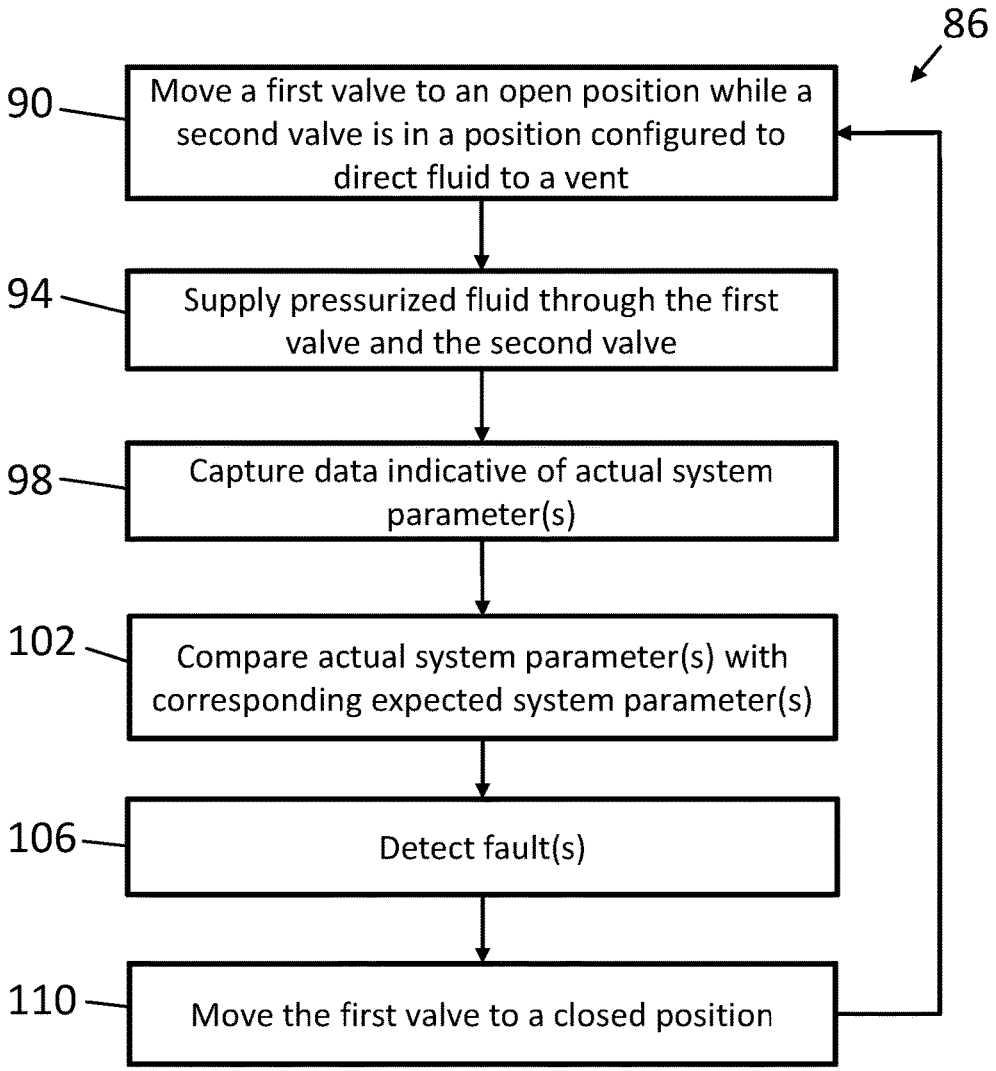
FIG. 2 depicts an embodiment of the present methods for assessing the reliability of component(s) associated with actuation of a hydraulically-actuated device.

System 10 can be configured to facilitate testing of system components without fully actuating hydraulically-actuated device 22. For example, FIG. 2 depicts an embodiment 86 of the present methods. Method 86 can be implemented, in part or in whole, by a processor (e.g., 78). At step 90, a first valve (e.g., 62) of a valve assembly (e.g., 18) can be moved to an open position while a second valve (e.g., 66) of the valve assembly is in a position configured to direct fluid to a vent (e.g., 54) (e.g., after step 90, the valve assembly is in the second state). At step 94, fluid from a pressure source (e.g., 26) can be supplied through the first and second valves and thereby be directed to the vent. By directing fluid from the pressure source to the vent, system (e.g., 10) components, such as the pressure source, first valve, and/or the like, can be actuated without fully actuating the hydraulically-actuated device.

At step 98, data indicative of one or more actual system parameters can be captured (e.g., using sensor(s) 74). Such actual system parameter(s) can include any suitable parameter, such as, for example, any one or more of those described above with respect to sensor(s) 74. At step 102, the actual system parameter(s) can be compared to corresponding expected system parameter(s). Such expected system parameter(s) can include, for example, known, minimum, maximum, calculated, commanded, and/or historical value(s). At step 106, fault(s) can be detected. For example, a fault can be detected if difference(s) between the actual and expected system parameter(s) exceed a threshold (e.g., the actual and expected system parameter(s) differ by 1, 5, 10, 15, 20% or more), a time rate of change of an actual system parameter (which may itself be a system parameter) is below or exceeds a threshold, an actual system parameter is below a minimum value or exceeds a maximum value, and/or the like. Further, a fault may be detected if, for example, a majority of (e.g., two out of three) sensor(s) 74 participating in a voting scheme capture data that indicates a fault. Faults detected at step 106 can be communicated to an above-sea control station, stored in a memory, and/or the like. At least a portion of steps 94, 98, 102, and/or 106 can be performed concurrently.

To illustrate, if the captured data indicates that the first valve is not in the open position (e.g., data captured by valve position sensor(s) 74, fluid flow rate and/or pressure sensor(s) 74 that are upstream and/or downstream of the first valve, and/or the like) when the first valve is expected to be in the open position, a fault associated with the first valve may be detected. To further illustrate, if the captured data indicates that a pressure and/or flow rate of fluid provided by the pressure source (e.g., data captured by fluid pressure and/or flow rate sensor(s) 74 and/or the like) is below a commanded, minimum, and/or historical value, a fault associated with the pressure source may be detected. To yet further illustrate, if the captured data indicates that a difference between a flow rate of fluid at a first location within the system (e.g., at inlet 46 of conduit 42) and a flow rate of fluid at a second location within the system (e.g., at vent 54) (e.g., data captured by fluid pressure and/or flow rate sensor(s) 74 and/or the like) exceeds a maximum value, a fault (e.g., leak) associated with the valve assembly may be detected.

At step 110, the first valve can be moved to a closed position. Steps 90-110 can be repeated any suitable number of times, and such repetition can occur at any suitable interval (e.g., 2, 4, 6, 8, 10, 12, or more hours, 1, 2, 3, 4, 5, 6, 7, 8, 9, 10, or more days, and/or the like). In these ways and others, method 86 and similar methods can provide for testing of component(s) (e.g., pressure source 26, first valve 62, second valve 66, and/or the like) that are associated with actuation of a hydraulically-actuated device (e.g., 22), without requiring full actuation of the hydraulically-actuated device. Such testing can be used to reduce a PFD of the component(s).

System 10 can include a processor 78, which can form part of a control unit 14. As shown, processor 78 and/or control unit 14 can be located subsea (e.g., coupled to other component(s) of system 10), and can be disposed within an atmospheric pressure vessel 82. Processor 78 can be configured to communicate with an above-sea control station to, for example, send and/or receive data, commands, signals, and/or the like. In some embodiments, a processor (e.g., 78) and/or control unit (e.g., 14) can be located above-sea (e.g., on an above-sea control station). As used herein, "processor" encompasses a programmable logic controller.

Processor 78 can be configured to actuate valve assembly 18. For example, processor 78 can be configured to move first valve 62 and/or second valve 66 to the first position, the second position, or any position between the first and second positions. More particularly, processor 78 can be configured to actuate valve assembly 18 based, at least in part, on data captured by sensor(s) 74. For example, processor 78 can adjust the position of first valve 62 and/or second valve 66 until the position of the first and/or second valves, a fluid flow rate and/or pressure within system 10, a position of a component (e.g., a ram) of hydraulically-actuated device 22, and/or the like, as indicated in data captured by sensor(s) 74, meets a commanded or threshold value. For further example, processor 78 can actuate valve assembly 18 to actuate BOP 30 if data captured by sensor(s) 74 indicates a loss of fluid and/or electrical communication between BOP stack 34 and an above-sea control station, disconnection of a lower marine riser package from the BOP stack, and/or the like (described in more detail below with respect to system 114). In some embodiments, a processor (e.g., 78) can be configured to control additional component(s) of a system (e.g., 10), such as, for example, a pressure source (e.g., 26) (e.g., a pump and/or motor thereof), and/or the like.

Figure 3:
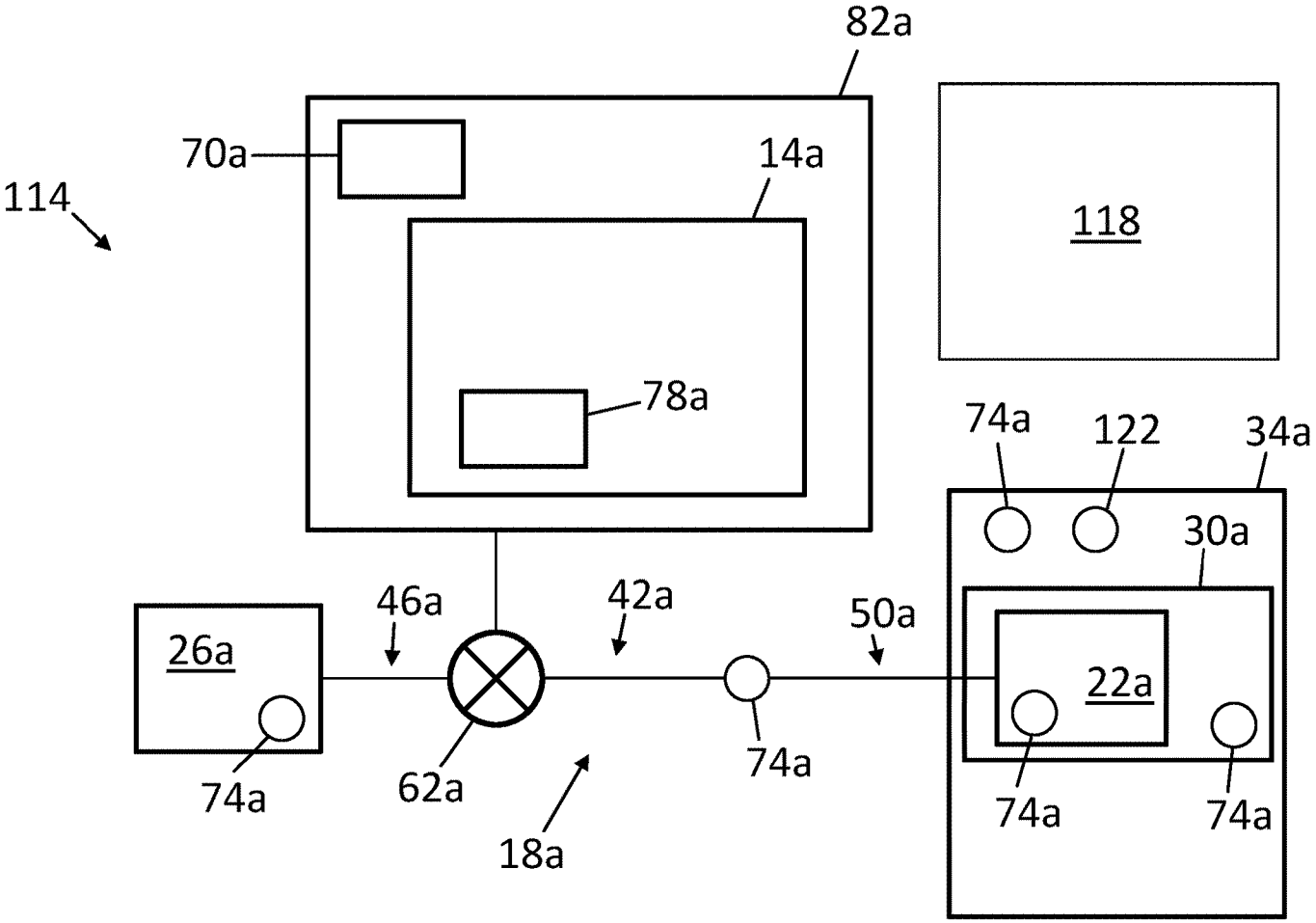
FIG. 3 is a schematic of a second embodiment of the present systems.

FIG. 3 shows a second embodiment 114 of the present systems. In this embodiment components that are similar in structure and/or function to those discussed above may be labeled with the same reference numerals and a suffix "a." While system 114 is depicted without a second valve 66, other embodiments that are otherwise similar to system 114 can include such a second valve (e.g., and can be capable of performing function(s) described above for system 10).

Hydraulically-actuated device 22*a* of system 114 can comprise a BOP 30*a*, and the system can be configured to function as a safety and/or back-up blowout prevention system. For example, processor 78*a* can be configured to actuate valve assembly 18*a* and/or pressure source 26*a* to actuate BOP 30*a* to close the wellbore in response to a command received from an above-sea control station (e.g., via a dedicated communication channel, acoustic interface, and/or the like), a signal from a traditional autoshear, deadman, and/or the like system, and/or the like.

For further example, processor 78*a* can be configured to actuate valve assembly 18*a* and/or pressure source 26*a* based, at least in part, on data captured by sensor(s) 74*a*. To illustrate, system 114 can include sensor(s) 74*a* configured to detect disconnection of a lower marine riser package 118 from BOP stack 34*a*, such as, for example, proximity sensor(s) (e.g., electromagnetic-, light-, or sound-based proximity sensor(s)), and processor 78*a* can be configured to actuate BOP 30*a* to close the wellbore based, at least in part, on data captured by the sensor(s). To further illustrate, system 114 can include one or more relays 122 and/or sensor(s) 74*a* configured to detect a loss of fluid and/or electrical communication between BOP stack 34*a* and an above-sea control station, and processor 78*a* can be configured to actuate BOP 30*a* to close the wellbore, based at least in part, on data captured by the sensor(s). The use of sensor(s) 74*a* and/or relay(s) 122 to detect disconnection of lower marine riser package 118 from BOP stack 34*a* and/or loss of fluid and/or electrical communication between the BOP stack and an above-sea control station can facilitate redundancy (e.g., two, three, or more sensors can be configured to capture data indicative of the same event), scalability (e.g., sensor(s) can be added and/or removed), and/or the like, thereby increasing fault-tolerance, reliability, and/or the like.

Figure 4:
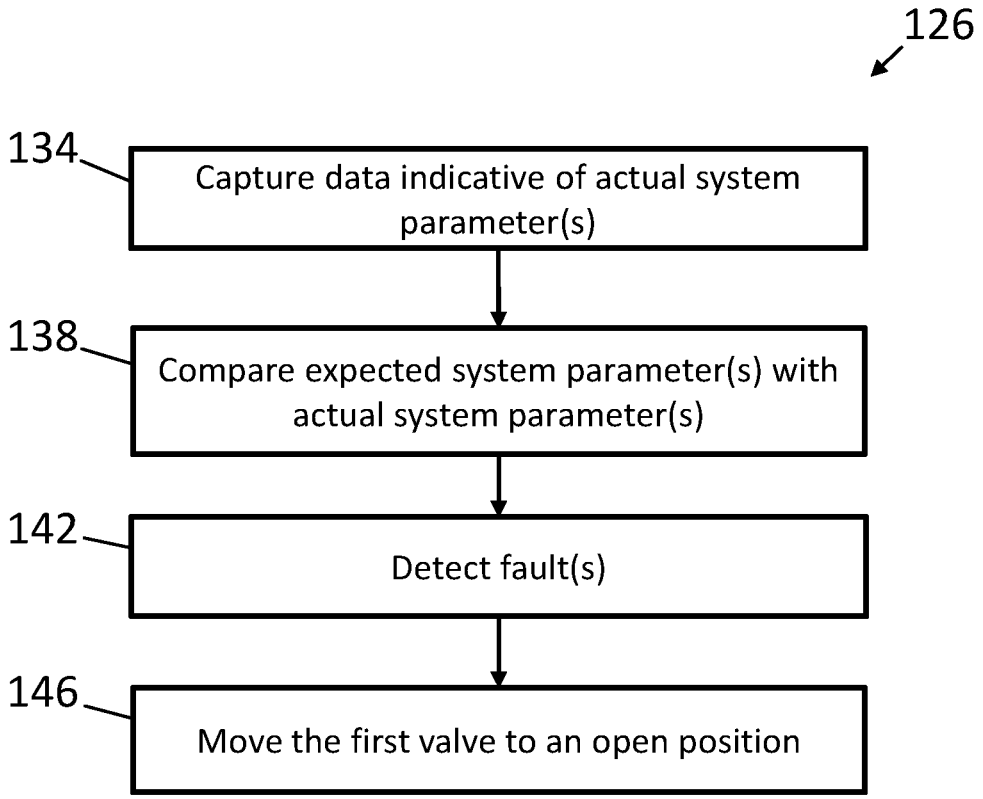
FIG. 4 depicts an embodiment of the present methods for actuating a hydraulically-actuated device.

For yet further example, FIG. 4 depicts an embodiment 126 of the present methods, which can be implemented, in part or in whole, by a processor (e.g., 78*a*). At step 134, data indicative of one or more actual system (e.g., 114) parameters can be captured (e.g., using sensors 74*a*). Such actual system parameter(s) can include any suitable parameter, such as, for example, any one or more of those described above with respect to sensor(s) 74. At steps 138 and 142, in a same or similar fashion to as described above for method 86, the actual system parameter(s) can be compared to corresponding expected system parameter(s) to detect fault(s). At step 146, if fault(s) are detected, depending on the nature of the fault(s), a valve assembly (e.g., 18*a*) and/or a pressure source (e.g., 26*a*) can be actuated in order to actuate a BOP (e.g., 30*a*) to close the wellbore.

In a system (e.g., 114) having a plurality of valve assemblies (e.g., 18*a*), after a first one of the valve assemblies is actuated to actuate its respective BOP (e.g., 30*a*), a second one of the valve assemblies can be actuated to actuate its respective hydraulically-actuated device. For example, the second one of the valve assemblies can be actuated after a predetermined period of time elapses from actuation of the first one of the valve assemblies.

The present systems (e.g., 10, 114) can include any suitable number of valve assembl(ies) (e.g., 18, 18*a*, and/or the like) (e.g., 1, 2, 3, 4, 5, 6, 7, 8, 9, 10, or more valve assemblies), each in fluid communication with any suitable number of pressure source(s) (e.g., 26, 26*a*, and/or the like) (e.g., 1, 2, 3, 4, 5, 6, 7, 8, 9, 10, or more pressure sources) and any suitable number of hydraulically-actuated device(s) (e.g., 22, 22*a*, and/or the like) (e.g., 1, 2, 3, 4, 5, 6, 7, 8, 9, 10, or more hydraulically-actuated devices).

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system comprising:

one or more valve assemblies configured to operate subsea, each having:

a conduit defining an inlet configured to be in fluid communication with a pressure source, an outlet configured to be in fluid communication with a respective subsea hydraulically-actuated device, and a vent configured to be in fluid communication with a reservoir and/or a subsea environment; and one or more valves in fluid communication with the conduit and including:

an electrically-actuated first valve that is movable between a first valve first position in which the first valve permits fluid communication from the inlet to the outlet and a first valve second position in which the first valve prevents fluid communication from the inlet to the outlet; and a second valve that is movable between a second valve first position in which hydraulic fluid that flows through the second valve from the first valve is directed to the outlet and a second valve second position in which hydraulic fluid that flows through the second valve from the first valve is directed to the vent;

one or more sensors configured to detect loss of fluid between the subsea hydraulically-actuated device and an above-sea control station; and a processor configured to actuate at least one of the valve assembly/assemblies between:

a first state in which the first valve is in the first valve first position and the second valve is in the second valve first position; and a second state in which the first valve is in the first valve first position and the second valve is in the second valve second position the processor further configured to actuate at least one of the valve assembly/assemblies to the first state to actuate the respective subsea hydraulically-actuated device that is in fluid communication with the at least one of the valve assembly/assemblies based, at least in part, on data captured by the one or more sensors.

2. The system of claim 1, where, for at least one of the valve assembly/assemblies, the second valve comprises an electrically-actuated valve.

3. The system of claim 2, where, for at least one of the valve assembly/assemblies, the second valve comprises a three-way valve.

4. The system of claim 1, where:

for at least one of the valve assembly/assemblies, the respective hydraulically-actuated device comprises a respective blowout preventer of a blowout preventer stack;

the one or more sensors further configured to detect:

electrical communication between the blowout preventer stack and the above-sea control station; and disconnection of a lower marine riser package from the blowout preventer stack.

5. The system of claim 4, where the one or more sensors include a proximity sensor configured to capture data indicative of disconnection of the lower marine riser package from the blowout preventer stack, a pressure sensor configured to capture data indicative of loss of fluid communication between the blowout preventer stack and the above-sea control station, a voltage sensor configured to capture data indicative of loss of electrical communication between the blowout preventer stack and the above-sea control station, or a combination thereof.

6. The system of claim 5, where at least one of the one or more sensors is configured to capture data indicative of a size of a tubular disposed through the blowout preventer stack.

7. The system of claim 5, where at least one of the one or more sensors is configured to capture data indicative of a position of a ram of a blowout preventer relative to a housing of the blowout preventer.

8. The system of claim 5, where at least one of the one or more sensors is configured to capture data indicative of at least one of: temperature, pressure, and flow rate of hydraulic fluid within the system.

9. A subsea system for a blowout preventer stack including one or more blowout preventers, the system comprising:

one or more valve assemblies, each having:

a conduit defining an inlet configured to be in fluid communication with a pressure source and an outlet configured to be in fluid communication with a respective blowout preventer of a blowout preventer stack; and one or more valves in fluid communication with the conduit and including an electrically-actuated first valve that is movable between a first valve first position in which the first valve permits fluid communication from the inlet to the outlet and a first valve second position in which the first valve prevents fluid communication from the inlet to the outlet;

one or more sensors configured to detect:

loss of fluid between the blowout preventer stack and an above-sea control station; and a processor configured to actuate at least one of the valve assembly/assemblies to actuate the respective blowout preventer that is in fluid communication with the at least one of the valve assembly/assemblies based, at least in part, on data captured by the one or more sensors, for at least one of the valve assembly/assemblies:

the conduit defines a vent configured to be in fluid communication with a reservoir and/or a subsea environment;

the one or more valves includes a second valve that is movable between a second valve first position in which hydraulic fluid that flows through the second valve from the first valve is directed to the outlet and a second valve second position in which hydraulic fluid that flows through the second valve from the first valve is directed to the vent; and the processor is configured to actuate at least one of the valve assembly/assemblies between:

a first state in which the first valve is in the first valve first position and the second valve is in the second valve first position; and a second state in which the first valve is in the first valve first position and the second valve is in the second valve second position.

10. The system of claim 9, where the pressure source comprises at least one selected from the group consisting of: a hydraulic power unit, an accumulator, and a subsea pump.

11. The system of claim 9, where the reservoir includes an accumulator, and further comprising one or more batteries configured to provide electrical power to the processor and/or at least one of the valve assembly/assemblies.

12. The system of claim 9, where, for at least one of the valve assembly/assemblies, the second valve includes an electrically-actuated valve or a three-way valve.

13. The system of claim 9, further comprising a relay configured to detect loss of electrical communication between the blowout preventer stack and the above-sea control station.

14. The system of claim 9, where the processor is configured to actuate at least one of the valve assembly/assemblies based, at least in part, on a command received from the above-sea control station.

15. The system of claim 9, where the processor is configured to:

actuate a first one of the valve assembly/assemblies to actuate the respective blowout preventer that is in fluid communication with the first one of the valve assembly/assemblies; and after a predetermined period of time has elapsed since actuating the first one of the valve assembly/assemblies, actuate a second one of the valve assembly/assemblies to actuate the respective blowout preventer that is in fluid communication with the second one of the valve assembly/assemblies.

16. The system of claim 15, where the processor is configured to, if data captured by the sensor(s) indicates a fault associated with the respective blowout preventer of a first one of the valve assembly/assemblies, actuate a second one of the valve assembly/assemblies to actuate the respective blowout preventer that is in fluid communication with the second one of the valve assembly/assemblies.

17. The system of claim 16, further comprising an atmospheric pressure vessel, where the processor is disposable within the atmospheric pressure vessel.

* * * * *